114-253

12/31/85 OR SR 4,561,375

United States Patent [19]

Paxton

[11] Patent Number: 4,561,375

[45] Date of Patent: Dec. 31, 1985

[54] TOW APPARATUS AND METHOD OF INSTALLATION

[76] Inventor: Harold G. Paxton, 71901 Sorrento Pl., Richmond, Va. 23233

[21] Appl. No.: 690,542

[22] Filed: Jan. 11, 1985

[51] Int. Cl.[4] ..... B63B 21/56

[52] U.S. Cl. ..... 114/253; 114/343; 280/480

[58] Field of Search ..... 114/242, 253, 254, 364, 114/343, 218, 91; 280/480; 248/237

[56] References Cited

U.S. PATENT DOCUMENTS

| | | | |
|---|---|---|---|
| 189,464 | 4/1877 | Hutchinson | 119/125 |
| 652,338 | 6/1900 | Tilley | 119/125 |
| 2,944,507 | 7/1960 | Beal | 114/235 |
| 3,122,609 | 2/1964 | Moore | 179/1 |
| 3,303,813 | 2/1967 | Collins et al. | 114/235 |
| 3,326,175 | 6/1967 | Baker | 114/235 |
| 3,655,160 | 4/1972 | Grillot | 248/188.8 |
| 3,890,918 | 6/1975 | Sell | 114/235 WS |
| 3,898,948 | 8/1975 | Huff | 114/91 |
| 3,919,963 | 11/1975 | Cox | 114/235 WS |

FOREIGN PATENT DOCUMENTS

| | | | |
|---|---|---|---|
| 2228657 | 12/1974 | France | 114/364 |

*Primary Examiner*—Sherman D. Basinger

*Attorney, Agent, or Firm*—Griffin, Branigan & Butler

[57] ABSTRACT

A tow apparatus (20) is installable in a moveable craft (11) for towing a load (18) situated behind the craft. The load (18) is connected to a selectively erectable, vertical post member (22) mountable on a floor deck (17) of the craft (11). When erected, the vertical post member (22) is further supported by two support members (26A, 26B) which are mounted on the floor deck (17) intermediate the vertical post member (20) and the stern (13) of the craft (11). The vertical post member (22) is mounted on floor deck (17) by engagement with a post anchor assembly (24). The support members (26A, 26B) are mounted on floor deck (17) by their engagement with corresponding support anchor assemblies (30A, 30B). The anchor assemblies (24,30) are installed on floor deck (17) in a manner whereby elements of the anchoring assemblies (24, 30) do not significantly protrude beyond the plane of the floor deck (17) when in a storage position (i.e., when the vertical post member (22) and support members (26A, 26B) are not erected).

10 Claims, 9 Drawing Figures

TOW APPARATUS AND METHOD OF INSTALLATION

BACKGROUND OF THE INVENTION

1. Field of the Invention

This invention pertains to tow apparatus, and particularly to tow apparatus installable on a vehicle such as small marine craft for such purposes as towing a water skier, for example.

2. Prior Art and Other Considerations

Perhaps the most common method for towing a water skier is the securing of a ski rope to the rear or stern of a marine craft. However, when a ski rope or any other towing structure is secured at the rear of motorized craft, i.e. aftward of the center of gravity of the craft, the force created by the skier upon start-up at least initially causes the bow of the craft to rise significantly out of the water. In such cases considerable time is often required for the craft to "plane out", making it more difficult for a skier to rise out of the water. Moreover, securing towing apparatus at the stern of the craft renders the craft less steerable and the direction of the craft somewhat influenced by the skier's movement as the skier skis from one side to the other.

In view of the foregoing, various prior art tow mechanisms have been secured forward of the stern of marine craft. According to some prior art tow devices, a vertical post or the like surmounted by a ring is mounted on a floor deck of a marine craft. The vertical post extends sufficiently high so that attachment of a ski rope to the ring gives a skier enhanced mobility. In some marine craft used to pull professional water skiers, the vertical post structure is permanently mounted on the floor deck of the craft. When not in use the permanently erect vertical post becomes an obstruction and greatly reduces usefulness of the neighboring floor deck areas. In this regard, the vertical post and associated support elements lessens the seating capacity and/or cargo storage space of the craft when the craft is employed for other uses.

Other vertical post-type ski tow structures are of a knock-down nature or can be temporarily erected by virtue of their connection to customized mounting members or the like which remain installed in the craft. Many of these temporarily erectable tow devices have doubtful structural stability when assembled. Moreover, disassembled devices of this type are prone to present significant safety hazards or, at best, are unsightly nuisances. In this respect, even when the vertical post is disassembled the mounting members significantly protrude above the floor deck or other surface to which they are installed. Passengers often trip over or stub their toe on protruding mounting members, especially when the passengers attempt to walk about in a craft which is moving or being rocked by waves. Articles of clothing, ski jackets and the like are especially prone to being snagged and even torn by protruding mounting members used for ski tow systems. The protruding mounting members reduce the amount of floor space available for conveniently storing other items such as picnic food containers, for example.

It is, therefore, an object of this invention to provide a selectively erectable tow mechanism for use with a moving vehicle.

An advantage of the present invention is the provision of a selectively erectable tow mechanism which, when not erected, does not significantly protrude beyond the interior surfaces of the craft.

Another advantage of the present invention is the provision of a selectively erectable tow mechanism which can be quickly assembled and disassembled.

A further advantage of the present invention is the provision of a selectively erectable tow mechanism which, when erected, has sound structural integrity.

Yet another advantage of the present invention is the provision of a relatively compact tow mechanism for a marine craft.

SUMMARY

A tow apparatus is installable in a moveable craft for towing a load situated behind the craft. The load is connected to a selectively erectable, vertical post member mountable on a floor deck of the craft. When erected, the vertical post member is further supported by two support members which are mounted on the floor deck intermediate the vertical post member and the stern of the craft. The vertical post member is mounted on floor deck by engagement with a post anchor assembly. The support members are mounted on floor deck by their engagement with corresponding support anchor assemblies. The anchor assemblies are installed on floor deck in a manner whereby elements of the anchoring assemblies do not significantly protrude beyond the plane of the floor deck in a storage position (i.e., when the vertical post member and support members are not erected).

The support anchor assemblies each comprise footing means and ankle means. The footing means includes a footing plate (which lies essentially flat on the floor deck) and footing walls (which extend perpendicularly from the bottom of the footing plate and which extend through an aperture in the floor deck). A channel is formed between the footing walls. The ankle means includes an ankle rod which, in the storage position, is accommodated essentially entirely in the channel but which, in a utility position, has an end which pivots out of and above the plane of the floor deck for mating engagement with a lower end of its corresponding support member.

A kit is provided whereby the just-described apparatus can be installed on a vehicle such as a marine craft using a method of the invention.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
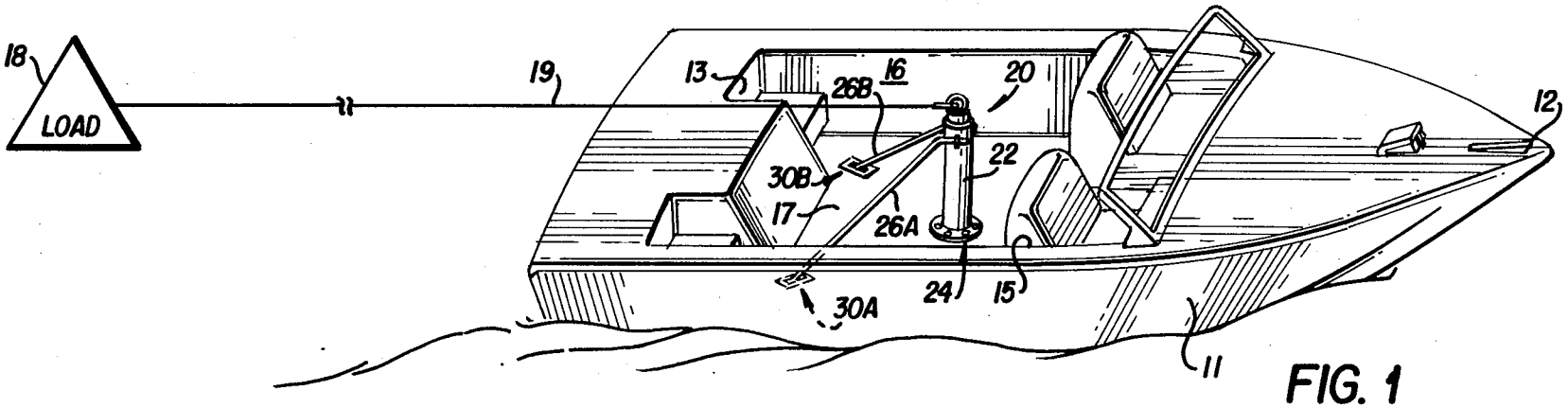
FIG. 1 is a perspective view of a tow apparatus according to an embodiment of the invention as installed in a marine craft.

FIG. 1 shows a marine craft 11 for towing a load situated behind the craft. The craft has a bow 12; a stern 13; and, interior surfaces such as interior sidewalls 15, 16, and floor deck 17. A load 18, such as a water skier, for example, is connected to a tow apparatus 20 by connecting means such as rope 19.

FIGS. 2 through 5 show in detail an embodiment of tow apparatus 20 which includes a vertical post member 22; a post anchor assembly 24; support members or rods 26A and 26B; and, support anchors 30A and 30B. In this respect, the tow apparatus 20 has vertical post member 22 secured to the floor deck 17 of the craft 11 by a post anchor assembly 24. The post anchor assembly 24 is mounted in an essentially planar portion of the floor deck 17. The vertical post member 22 has the upper ends of support members 26A, 26B connected thereto near the top of the vertical post member 22. The lower ends of support members 26A, 26B are connected to the respective support anchor assemblies 30A and 30B which are mounted in an essentially planar portion of the floor deck 17. A connection ring 31 is mounted to the top of vertical post member 22 so that connecting means 19 can be tied or otherwise secured thereto.

The post anchor assembly 24 includes a post receptacle 32 having a receptacle plate 34 and a receptacle cylinder 36. The receptacle plate 34 is circular and has a central aperture 38 therein to accommodate the lower end of the vertical post 22. A pair of lugs 40 provided on the lower end of the post 22 are accommodated through the aperture 38 when aligned with corresponding notches 42 provided on the inner diameter of the plate 34. In one embodiment the lugs 40 are formed by drilling a hole through the diameter of the lower end of vertical post member 22; inserting a solid rod transversely through the drilled hole in post 22 (the rod having two holes drilled through its diameter); and, inserting cotter keys into the rod holes whereby the rod remains stationary relative to the vertical post member 22.

The receptacle cylinder 36 has a major axis 44 which is perpendicular to the plane of the receptacle plate 34 and which is aligned with the center of the receptacle plate aperture 38. The receptacle cylinder 36 is essentially hollow for accommodating therein the lower end of the post 22. Moreover, the receptacle cylinder 36 includes on its inner diameter two axially extending grooves 46 which receive the corresponding lug means 40 when properly aligned.

Figure 5A:
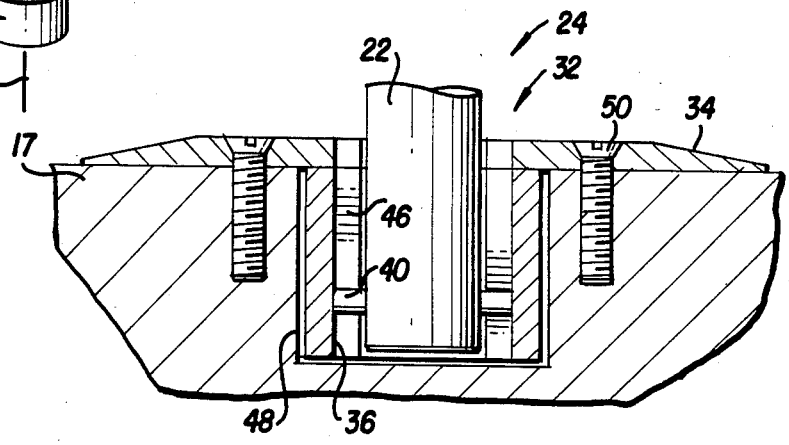
FIGS. 5A and 5B are side views of post anchoring means according to embodiments of FIG. 1 for installment upon thick and thin floor decks, respectively.
Figure 5B:
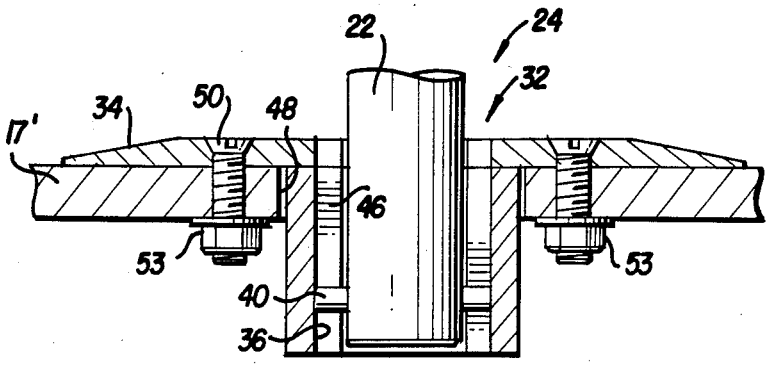

The entire post receptacle 32 is inserted into a circular aperture 48 in an essentially planar portion of the floor deck 17 and secured thereto with fasteners such as screws 50 which extend through apertures 52 and into the plate 34 such that the post anchor assembly 24 is flush mounted with the floor deck 17. FIG. 5A shows an embodiment wherein floor deck 17 is sufficiently thick that screws 50 are totally anchored within the deck 17. FIG. 5B shows, on the other hand, an embodiment featuring a thin floor deck 17' and in which nuts 53 are secured onto the lower ends of screws 50 beneath floor deck 17'.

Figure 3:
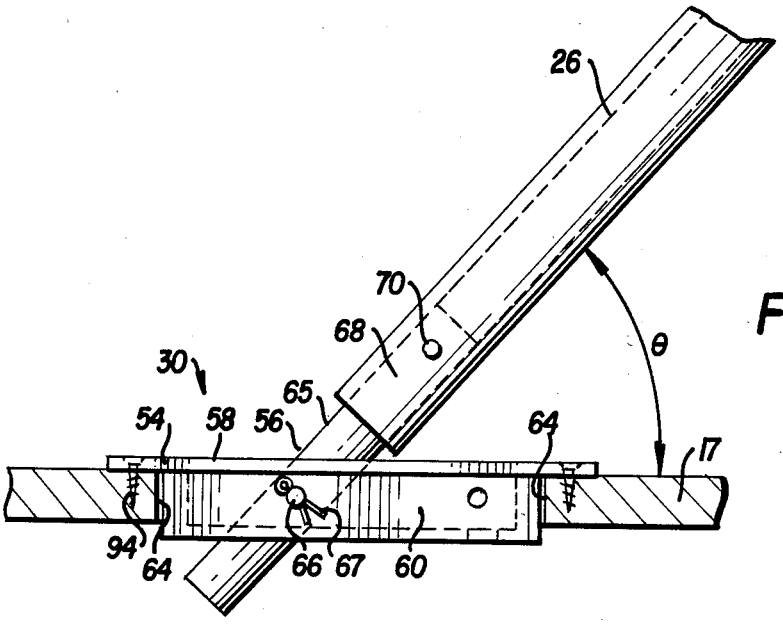
FIG. 3 is a side view of footing means included in a tow apparatus of the embodiment of FIG. 1 and shown in a utility position.

The support anchor assemblies 30A, 30B each include foot members 54 and ankle members 56. The foot members each comprise footing plates 58 and footing walls 60. The footing walls 60 are perpendicular to the footing plates 58 and extend from one side of the plate 58 to form a channel 62. In the illustrated embodiment four footing walls 60 are shown as forming an essentially rectangular channel 62. Each support anchor assembly 30 is insertable into a complementary shaped aperture in an essentially planar portion of an interior surface of the craft 11. As shown in FIG. 3, each support anchor assembly 30 is insertable into respective aperture 64 in the floor deck 17 in a manner whereby the footing plate 58 abuts the planar portion of floor deck 17 and the footing walls 60 extend into the aperture 64.

Figure 4:
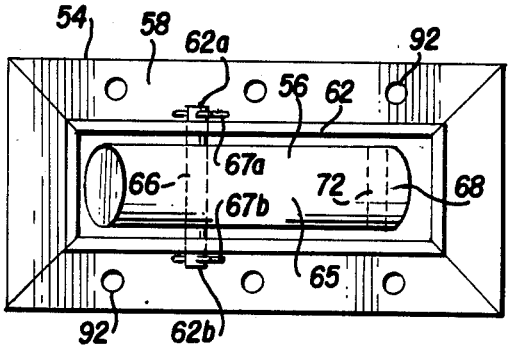
FIG. 4 is a top view of the footing means of FIG. 3 but shown in a storage position.
Figure 7A:
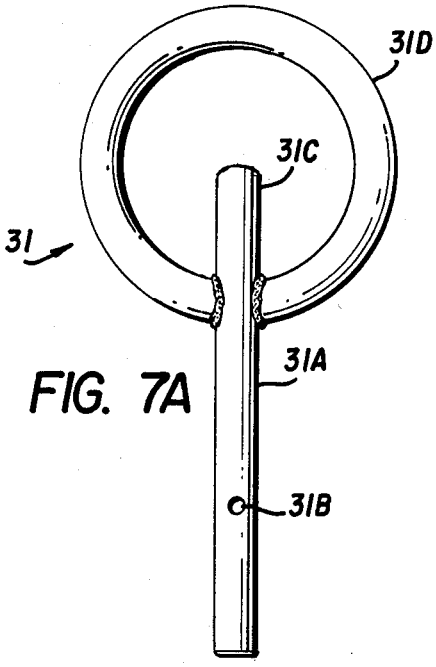
Figure 7B:
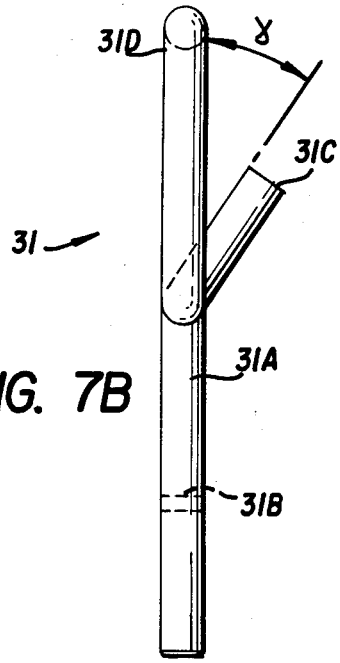

Ankle member 56 includes a short, cylindrical rod 65 having a first end and a second end. Near its first end the ankle rod 65 has running transversely therethrough a pivot pin 66. Pivot pin 66 has its opposite ends **66*a*, 66*b* rotatably captured between opposing footing walls 60 by pins 67. The ankle rod 65 is sized with an appropriate length and diameter whereby ankle member 56 is positionable entirely inside the channel 62 while in a storage position as shown in FIG. 4. Alternatively, by virtue of the action of pivot pin 66, the ankle member 56 can be positioned upwardly in a utility position as shown in FIG. 3. When the ankle member 56 is in a utility position, a second end thereof (distal portion 68) extends above the footing plate 58 and at an angle theta thereto. The distal portion 68 mates with the lower end of the respective support member 26. In the illustrated embodiment, the hollow lower end of the support member 26 receives the distal portion 68 of the ankle rod 65 for an interfeeding connection. The support members 26 are hollow and have at their lower ends a pair of aligned apertures 70 which align with an aperture 72 in the ankle rod 65 to receive a fastener such as bolt 74, the threaded distal end of which receives a wing nut 76**.

Each support rod 26 has an axis 80 colinear with at least one of its ends. The other end of the rod 26 is bent at an angle alpha with respective axis 80. At the angled upper end of each support rod 26 are aligned apertures 82 which align with corresponding apertures 84 in the vertical post 22 whereby fastening means such as threaded bolt 86 may be inserted through the aligned apertures 82, 84 and secured with wing nuts 88.

The top of vertical post member 22 is essentially hollow and receives therein a shank portion 31A of the ring connector 31. A lower end of shank 31A has an aperture 31B through its diameter which, in one embodiment, accommodates the bolt 86. An upper end of shank 31A has an angled portion 31C thereof which is bent at an angle gamma with respect to the major axis of the shank. The angle gamma is, in a preferred embodiment, on the order of about 32 degrees. At the point whereat angled portion 31C bends with respect to shank 31A the shank 31A has a circular ring 31D welded thereto.

Each footing plate 68 has a plurality of apertures 92 therein. Flat-headed fasteners such as screws 94 have shank portions which extend through the apertures 92 and into the floor deck 17.

Figure 6:
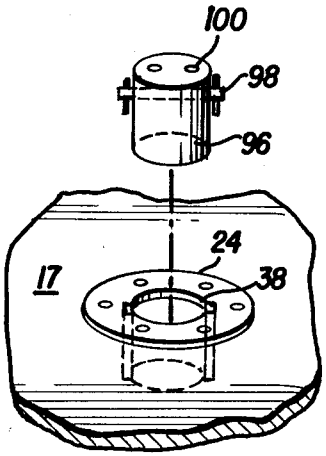
FIG. 6 is a perspective view of a post receptacle assembly and a plug therefor according to an embodiment of the invention; and, FIGS. 7A and 7B are front and side views, respectively, of ring connection means according to an embodiment of the invention.
Figure 2:
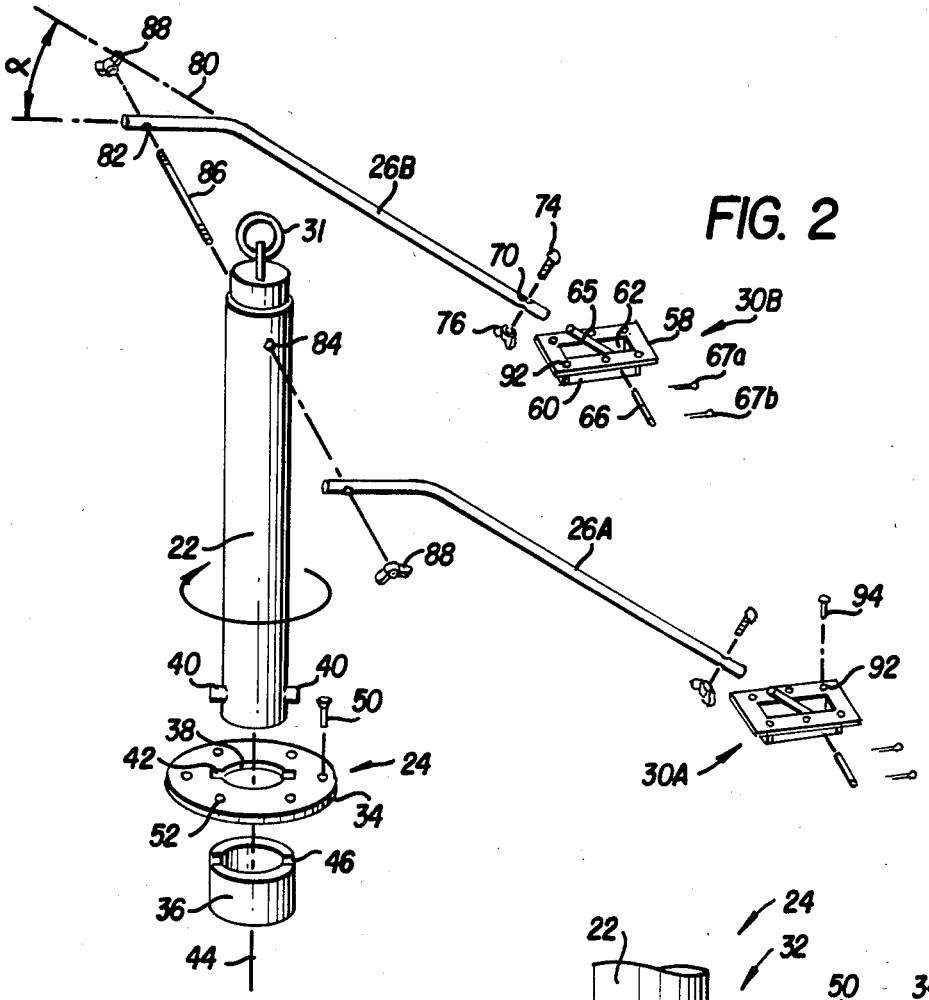
FIG. 2 is an exploded view of the tow apparatus of FIG. 1.

A plug 96 as shown in FIG. 6 is provided for insertion into post receptacle aperture 38 of post anchor assembly 24 when the tow apparatus is in its storage position (i.e. when the vertical post member 22 is not standing erect in the post anchor assembly 24). The plug 96 is essentially cylindrically shaped and sized to fit into the receptacle aperture 38 so that the top of the plug 96 is essentially level with the top of the receptacle plate 34. The plug 96 has two lugs 98 provided thereon much in the manner as lugs 40 are provided on the vertical post member 22. The top of plug 96 has two finger holes 100 provided therein in like manner as finger holes provided on a bowling ball whereby the plug 96 is lifted in and out of aperture 36, and whereby the plug 96 can be rotated so that lugs 98 thereon lock the plug 96 into the interior diameter circumferential grooves provided in receptacle cylinder 36.

It is understood from the foregoing that the apparatus of the present invention provides anchor assemblies which do not significantly protrude beyond the essentially planar interior surfaces of the craft, but which instead are essentially flush with such surfaces. Thus, when the tow apparatus 20 of the present invention is not in use, the permanently installed anchor assemblies 24, 26 do not interfere with other operations or activities in the craft and are not unseemly.

To install the tow apparatus 20 of the present invention, an aperture such as aperture 48 is cut in floor deck 17 near the midsection of craft 11. The aperture 48 is cut of sufficient size as to tightly receive the cylinder 36 of post anchor assembly 24. Post anchor assembly 24 is then inserted into aperture 48. Fasteners 50 are screwed through corresponding apertures 52 and post anchor assembly 24 and into the floor deck 17.

Apertures 64A and 64B are also cut into floor deck 17, but in positions intermediate the location of the post anchor assembly 24 in the stern 13. The support anchor assemblies 30A and 30B are then inserted into respective apertures 64A, 64B with footing walls 60 extending into the aperture 64 and with the footing plate 58 lying flush over floor deck 17. Fasteners 94 are then screwed through their corresponding apertures 92 and footing plate 58 and into the floor deck 17. As shown in FIG. 1, apertures 64 are cut and anchor assemblies 30A, 30B inserted therein whereby anchor assemblies 30A, 30B are equally spaced about the longitudinal center of craft 11 and angled toward the post 22 in the aftward direction. The distance of the support anchor assemblies 30 from the post 22 depends, of course, on the configuration and length of the support members 26.

Vertical post 22 is then vertically erected in its anchoring assembly 24. In this regard, lugs 40 on the lower end of the post 22 are aligned with notches 42 and plate 32 and grooves 46 and cylinder 36. When lowered to the bottom of the cylinder 36, the post 22 is rotated so that the lugs 40 are locked in inner diameter circumferential grooves in cylinder 36 in conventional fashion. With the lugs 40 and thus post 22 locked into the post anchor assembly 24, ring 90 and apertures 84 are properly oriented for appropriate connections to the tow rope 19 and support members 26, respectively.

For the tow assembly 20 to be configured in a utility position, the following further steps are followed. Ankle rods 65 are rotated upwardly about pivot pin 66 through an appropriate angle theta as shown in FIG. 3. The hollow lower ends of the respective support members 26 are fitted over the corresponding distal end 68 of the ankle rods 65. The apertures 70 and 72 of the support rods 26 and ankle rods 65, respectively, are aligned and the fasteners 74 inserted therethrough. At their top ends the apertures 82 and support rods 26 are aligned with apertures 84. Threaded bolt 86 is inserted through both support rods 26A, 26B and post 22 sandwiched therebetween. Wing nuts 88 are then tightened on each end of the threaded bolt 86.

While the invention has been particularly shown and described with reference to the preferred embodiment thereof, it will be understood by those skilled in the art that various alterations in form and detail may be made therein without departing from the spirit and scope of the invention. For example, the ankle rods 65 can be hollow to receive small diameter support rods 26. Moreover, rather than using a pivot pin 66, the support anchor assemblies 30 can utilize in other embodiments a ball-and-socket arrangement. Furthermore, for some craft the support anchor assemblies 30 can be mounted on interior surfaces other than a floor deck, such as opposing interior side walls, for example.

The embodiments of the invention in which an exclusive property or privilege is claimed are defined as follows:

1. Tow apparatus installable in a movable craft for towing a load situated behind said craft, said craft having at least one interior surface including an essentially planar portion thereof, said apparatus comprising:

an essentially vertical post member adapted to have means connectable to said load secured thereto;

means for anchoring said vertical post member to a planar portion associated with one of said interior surfaces;

at least one support member having an upper end thereof connectable to said vertical post member proximate the top of said vertical post member; and, means for anchoring said support member to a planar portion associated with one of said interior surfaces, said support member anchoring means comprising:

footing means, said footing means comprising a footing plate and two footing walls perpendicular thereto, said walls extending from one side of said plate to form a channel therebetween, said footing means being insertable into a complementary shaped aperture in said planar portion of said interior surface in a manner whereby said footing plate abuts said planar portion and said footing walls extend into said aperture; ankle means, said ankle means being positionable in at least a storage position and a utility position, said ankle means in said storage position being essentially entirely accommodated in said footing channel, said ankle means in said utility position having a distal portion thereof extending beyond said footing plate and at an angle thereto, said distal portion of said ankle means having thereon means for mating with a lower end of said support member; and, means for selectively moving said ankle means between said storage position and said utility position.

2. The tow apparatus of claim 1, wherein said means for selectively moving said ankle means comprises a pivot pin about which said ankle means pivots, said pivot pin having opposite ends thereof connected to said footing walls.

3. The tow apparatus of claim 1, wherein said footing means comprising said means for anchoring said support member is insertable into said complementary shaped aperture, and wherein said complementary shaped aperture is located on said planar surface at a point intermediate said means for anchoring said vertical post member and said load.

4. The tow apparatus of claim 1, wherein said means for anchoring said vertical post member comprises:

radially extending lug means provided proximate the lower end of said vertical post member;

post receptacle means, said post receptacle means comprising a receptacle plate and a receptacle cylinder, said receptacle cylinder being insertable into a complementary shaped aperture in a planar portion of said interior surface and connected to an underside of said receptacle plate, said receptacle plate having an aperture therein to accommodate said lower end of said vertical post member and said lug means provided thereon, said receptacle cylinder having a major axis perpendicular to the plane of said receptacle plate and aligned with said receptacle plate aperture, said receptacle cylinder being essentially hollow for reception therein of said lower end of said post; and, means for locking said lug means into said receptacle cylinder.

5. The tow apparatus of claim 4, wherein said receptacle plate is secured to said planar portion of said interior surface.

6. The tow apparatus of claim 1, wherein two support members are provided, each support member being a rod having an axis colinear with at least a first end of said rod, the other end of said rod being angled with respect to said axis.

7. A kit for installing a tow apparatus in a movable craft whereby said tow apparatus is usable to tow a load behind said craft, said kit comprising:

a post member positionable in an essentially vertical orientation, said post member having secured thereto means for facilitating connection of said tow apparatus to said load;

means for anchoring said post member to a planar portion of an interior surface of said craft whereby said post member assumes an essentially vertical orientation;

at least one support member;

means for connecting said support member proximate a top end of said post member; and, means for anchoring said support member to a planar portion associated with an interior surface of said craft, said support member anchoring means comprising:

footing means, said footing means comprising a footing plate and two footing walls perpendicular thereto, said walls extending from one side of said plate to form a channel therebetween, said footing means being insertable into a complementary shaped aperture in said planar portion of said interior surface in a manner whereby said footing plate abuts said planar portion and said footing walls extend into said aperture;

ankle means, said ankle means being positionable in at least a storage position and a utility position, said ankle means in said storage position being essentially entirely accommodated in said footing channel, said ankle means in said utility position having a distal portion thereof extending beyond said footing plate and at an angle thereto, said distal portion of said ankle means having thereon means for mating with a lower end of said support member; and, means for selectively moving said ankle means between said storage position and said utility position.

8. The kit of claim 7, wherein said means for selectively moving said ankle means comprises a pivot pin about which said ankle means pivots, said pivot pin having opposite ends thereof connected to said footing walls.

9. The kit of claim 7, wherein said post anchoring means comprises a receptacle having an aperture therein adapted to receive the lower end of said post member when said tow apparatus is in said utility position, and wherein said kit further includes a plug member insertable into said receptacle aperture when said tow apparatus is in said storage position.

10. A method of installing a tow apparatus in a movable craft, said method comprising the steps of:

creating a first aperture in an essentially planar portion of an interior surface of said craft;

inserting a receptacle into said first aperture, said receptacle being adapted to receive a lower end of a post member and to orient said post member in an essentially vertical orientation;

inserting said post member into said receptacle whereby said post member assumes said essentially vertical orientation;

creating a second aperture in an essentially planar portion of an interior surface of said craft;

inserting footing means into said second aperture, said footing means comprising a footing plate and footing walls perpendicular thereto, said footing walls extending from one side of said plate and into said second aperture to form a channel between said footing walls;

connecting ankle means to said footing means in a manner whereby said ankle means is positionable in at least a storage position and a utility position, said ankle means in said storage position being essentially entirely accommodated in said footing channel, said ankle means in said utility position having a distal portion thereof angularly extending beyond said footing means;

securing said footing means to said essentially planar portion of said interior surface of said craft;

mating said distal end of said ankle means with a lower end of a support member; and, connecting an upper end of said support member to said essentially vertical post member proximate a top end of said post member.

* * * * *